US011649518B2

(12) United States Patent
Lee et al.

(10) Patent No.: US 11,649,518 B2
(45) Date of Patent: May 16, 2023

(54) ULTRA-THICK STEEL MATERIAL HAVING EXCELLENT SURFACE PART NRL-DWT PROPERTIES AND METHOD FOR MANUFACTURING SAME

(71) Applicant: POSCO, Pohang-si (KR)

(72) Inventors: Hak-Cheol Lee, Pohang-si (KR); Sung-Ho Jang, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 291 days.

(21) Appl. No.: 16/469,483

(22) PCT Filed: Dec. 20, 2017

(86) PCT No.: PCT/KR2017/015057
§ 371 (c)(1),
(2) Date: Jun. 13, 2019

(87) PCT Pub. No.: WO2018/117614
PCT Pub. Date: Jun. 28, 2018

(65) Prior Publication Data

US 2019/0390292 A1 Dec. 26, 2019

(30) Foreign Application Priority Data

Dec. 22, 2016 (KR) ..... 10-2016-0176553

(51) Int. Cl.

| | |
|---|---|
| ***C21D 9/46*** | (2006.01) |
| ***C21D 8/02*** | (2006.01) |
| ***C21D 6/00*** | (2006.01) |
| ***C22C 38/14*** | (2006.01) |
| ***C22C 38/12*** | (2006.01) |
| ***C22C 38/08*** | (2006.01) |
| ***C22C 38/06*** | (2006.01) |
| ***C22C 38/02*** | (2006.01) |
| ***C22C 38/04*** | (2006.01) |
| ***C22C 38/00*** | (2006.01) |

(52) U.S. Cl.
CPC ..... *C21D 9/46* (2013.01); *C21D 6/005* (2013.01); *C21D 6/008* (2013.01); *C21D 8/0205* (2013.01); *C21D 8/0226* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C21D 2211/001* (2013.01); *C21D 2211/002* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | |
|---|---|---|---|
| 2015/0075680 | A1 | 3/2015 | Tanaka et al. |
| 2017/0335424 | A1 | 11/2017 | Lee et al. |
| 2019/0093204 | A1 | 3/2019 | Lee et al. |

FOREIGN PATENT DOCUMENTS

| | | | | |
|---|---|---|---|---|
| CN | 104428435 | A | | 3/2015 |
| EP | 2520683 | B1 | | 11/2016 |
| JP | 2004-244655 | A | | 9/2004 |
| JP | 2008-202119 | A | | 9/2008 |
| JP | 2013-204145 | A | | 10/2013 |
| JP | 2015-183273 | A | | 10/2015 |
| KR | 10-2015-0003280 | A | | 1/2015 |
| KR | 10-2015-0075319 | A | | 7/2015 |
| KR | 10-2015-0086549 | A | | 7/2015 |
| KR | 10-2015-0112489 | A | | 10/2015 |
| KR | 10-2016-0078927 | A | | 7/2016 |
| KR | 10-2016-0078928 | A | | 7/2016 |
| KR | 10-2016-0079163 | A | | 7/2016 |
| KR | 10-2016-0079165 | A | | 7/2016 |
| KR | 20160079165 | A | * | 7/2016 |
| WO | 2016/105064 | A1 | | 6/2016 |

OTHER PUBLICATIONS

F.G. Caballero, M.K. Miller, C. Garcia-Mateo, J. Cornide, M.J. Santofimia. Temperature dependence of carbon supersaturation of ferrite in bainitic steels. Scripta Mater., 67 (2012), pp. 846-849. (Year: 2012).*

International Search Report dated Mar. 30, 2018 issued in International Patent Application No. PCT/KR2017/015057 (with English translation).

Chinese Office Action dated Jul. 24, 2020 issued in Chinese Patent Application No. 201780079348.6 (with English translation).

Japanese Office Action dated Aug. 25, 2020 issued in Japanese Patent Application No. 2019-529553.

* cited by examiner

*Primary Examiner* — Anthony M Liang
(74) *Attorney, Agent, or Firm* — Morgan, Lewis & Bockius LLP

(57) ABSTRACT

Disclosed are a high-strength ultra-thick steel material and a method for manufacturing same. The high-strength ultra-thick steel material comprises in weight % 0.04-0.1% of C, 0.05-0.5% of Si, 0.01-0.05% of Al, 1.6-2.2% of Mn, 0.5-1.2% of Ni, 0.005-0.050% of Nb, 0.005-0.03% of Ti and 0.2-0.6% of Cu, 100 ppm or less of P and 40 ppm or less of S with a balance of Fe, and inevitable impurities, and comprises, in a subsurface area up to t/10 (t hereafter being referred to as the thickness of the steel material), bainite of 90 area % or greater (including 100 area %) as microstructures. And the particle size of crystallites having a high inclination angle boundary of 15° or higher measured by EBSD is 10 μm or less (not including 0 μm).

9 Claims, No Drawings

ULTRA-THICK STEEL MATERIAL HAVING EXCELLENT SURFACE PART NRL-DWT PROPERTIES AND METHOD FOR MANUFACTURING SAME

CROSS-REFERENCE OF RELATED APPLICATIONS

This application is the U.S. National Phase under 35 U.S.C. § 371 of International Patent Application No. PCT/KR2017/015057, filed on Dec. 20, 2017, which in turn claims the benefit of Korean Application No. 10-2016-0176553, filed on Dec. 22, 2016, the entire disclosures of which applications are incorporated by reference herein.

TECHNICAL FIELD

The present disclosure relates to an ultra-thick steel material having excellent surface NRL-DWT physical properties and a method of manufacturing the same.

BACKGROUND ART

Recently, it has been required to develop high-strength ultra-thick steel materials for the design of structures such as domestic and internationally built ships or the like, which is because when the high-strength ultra-thick steel materials are used in the design of structures, the structures maybe made thinner and the thicknesses of the structures may be thinned, in addition to economical benefits based on a lightweighted structural form, thereby facilitating processing and welding.

Generally, in the production of high-strength ultra-thick steel materials, since the reduction in a total rolling reduction rate does not cause sufficient strain in the whole structure, the structure is coarsened. Further, during rapid cooling for securing strength, a difference in cooling rates between a surface portion and a central portion occurs due to a relatively great thickness. As a result, a large amount of coarse low-temperature transformation phase such as bainite occurs on a surface portion, and thus, it may be difficult to secure toughness. In detail, in the case of brittle crack propagation resistance indicating stability of the structure, there is an increasing demand for assurance when applied to major structures, such as ships. In the case of ultra-thick steel, it is significantly difficult to guarantee such brittle crack propagation resistance due to lowering of toughness.

In practice, many classification societies and steel makers have conducted large tensile tests that may accurately evaluate brittle crack propagation resistance to guarantee brittle crack propagation resistance. However, in this case, a large amount of costs may be incurred to perform the tests, and thus, it may be difficult to guarantee application thereof to mass production. To reduce such unreasonability, researches into mini-scale tensile tests that may replace large-scale tensile tests have been steadily conducted. As the most promising test, the surface portion Naval Research Laboratory-Drop Weight Test (NRL-DWT) of ASTM E208-06 has been adopted by many classification societies and steel makers.

The NRL-DWT on a surface portion is adopted based on the research result that in the case of controlling a microstructure of a surface portion in addition to the existing research, a crack propagation speed is slowed at brittle crack propagation, brittle crack propagation resistance is excellent. Various techniques such as surface cooling during finishing rolling for fine surface grain size and grain size control by providing bending stress during rolling have been devised by other researchers to improve NRL-DWT physical properties. However, there is a problem in which productivity is greatly lowered in applying the technology itself to a general production system.

On the other hand, it is known that when a large amount of elements such as Ni and the like are added to improve toughness, NRL-DWT surface properties may be improved. However, since such elements are expensive elements, commercial use thereof may be difficult in terms of manufacturing costs.

DISCLOSURE

Technical Problem

An aspect of the present disclosure is to provide an ultra-thick steel material excellent in physical properties of surface portion NRL-DWT and a method of manufacturing the same.

Technical Solution

According to an aspect of the present disclosure, a high-strength ultra-thick steel material includes, by weight %, 0.04 to 0.1% of carbon (C), 0.05 to 0.5% of silicon (Si), 0.01 to 0.05% of aluminum (Al), 1.6 to 2.2% of manganese (Mn), 0.5 to 1.2% of nickel (Ni), 0.005 to 0.050% of niobium (Nb), 0.005 to 0.03% of titanium (Ti), 0.2 to 0.6% of copper (Cu), 100 ppm or less of phosphorus (P) , and 40 ppm or less of sulfur (S) with a remainder of iron (Fe), and inevitable impurities, and in a subsurface area up to t/10 (t hereafter being referred to as a thickness (mm) of a steel material), bainite of 90 area % or greater (including 100 area %) as a microstructure of the high-strength ultra-thick steel material. A particle size of crystalline grains of the steel material, having a high inclination angle boundary of 15° or higher measured by EBSD, is 10 μm or less (excluding 0 μm).

According to another aspect of the present disclosure, a method of manufacturing a high-strength ultra-thick steel material includes reheating a slab including, by weight %, 0.04 to 0.1% of carbon (C), 0.05 to 0.5% of silicon (Si), 0.01 to 0.05% of aluminum (Al), 1.6 to 2.2% of manganese (Mn), 0.5 to 1.2% of nickel (Ni), 0.005 to 0.050% of niobium (Nb), 0.005 to 0.03% of titanium (Ti), 0.2 to 0.6% of copper (Cu), 100 ppm or less of phosphorus (P), and 40 ppm or less of sulfur (S) with a remainder of iron (Fe), and inevitable impurities, and rough-rolling the slab reheated in the reheating, and then, cooling the slab to a temperature of Ar3° C. or higher to (Ar3+100)° C. or lower, at a rate of 0.5° C./sec or more, and finish-rolling the slab cooled in the cooling, and then, water-cooling the slab.

Advantageous Effects

According to an aspect of the present disclosure, an ultra-thick steel material for a structure has excellent physical properties of surface portion NRL-DWT.

Various and positive properties and effects according to an embodiment of the present disclosure are not limited to the above descriptions, and may be more easily understood in the course of describing a detailed embodiment of the present disclosure.

BEST MODE FOR INVENTION

Hereinafter, an ultra-thick steel material excellent in terms of physical properties of surface portion NRL-DWT, according to an embodiment of the present disclosure, will be described in detail.

First, an alloy component and a required content range of an ultra-thick steel material according to an embodiment of the present disclosure will be described in detail. It is to be noted that the contents of respective components described below are based on weight unless otherwise specified.

C: 0.04 to 0.1%

In the present disclosure, carbon is a significantly important element in securing basic strength, and thus, it is necessary to be contained in steel in an appropriate range. To obtain such effects in the present disclosure, the content of carbon may be 0.04% or more. However, if the content exceeds 1.0%, hardenability is improved and a relatively large amount of martensite-austenite constituent is generated and generation of a low-temperature transformation phase is promoted, thereby lowering toughness. Therefore, the content of C may be 0.04 to 1.0%, in more detail 0.04 to 0.09%.

Si: 0.05 to 0.5%, Al: 0.01 to 0.05%

Si and Al are alloy elements essential for deoxidation by precipitating dissolved oxygen in molten steel in slag form during steel making and a continuous casting process, and 0.05% or more and 0.01% or more of Si and Al, respectively, are generally included in the production of steel using a converter. However, if the content is excessive, a Si or Al composite oxide may be produced in a relatively coarse, or a large amount of coarse-phase martensite-austenite constituent may be generated in a microstructure. To prevent this, an upper limit of the Si content maybe limited to 0.5%, in more detail limited to 0.4%, and an upper limit of the Al content may be limited to 0.05%, and limited to 0.04% in more detail.

Mn: 1.6 to 2.2%

Mn is a useful element for improving hardenability to improve strength by solid solution strengthening and to produce a low temperature transformation phase, and therefore, it is necessary to add Mn of 1.6% or more to satisfy yield strength of 460 MPa or more. However, the addition of more than 2.2% promotes formation of upper bainite and martensite due to an excessive increase in hardenability, which may greatly reduce impact toughness and surface NRL-DWT physical properties. Therefore, the Mn content maybe 1.6 to 2.2%, and in more detail 1.6 to 2.1%.

Ni: 0.5 to 1.2%

Ni is an important element for improving strength by improving cross-slip of dislocations at low temperature to improve impact toughness and hardenability. To improve impact toughness and brittle crack propagation resistance in a high-strength steel having a yield strength of 460 MPa or higher, Ni may be added in an amount of 0.5% or more. However, if Ni is added in an amount of more than 1.2%, hardenability is excessively increased, and thus, a low temperature transformation phase is generated, thereby lowering toughness, which raises manufacturing costs. Therefore, the Ni content may be 0.5 to 1.2%, in more detail, 0.6 to 1.1%.

Nb: 0.005 to 0.050%

Nb is precipitated in the form of NbC or NbCN to improve strength of a base material. In addition, Nb solidified at the time of reheating at a high temperature is extremely finely precipitated in the form of NbC at the time of rolling, thereby suppressing recrystallization of austenite such that the structure may be fine. Therefore, Nb may be added in an amount of 0.005% or more, but if it is added in excess of 0.050%, there is a possibility of causing a brittle crack in the corner of the steel. Therefore, the Nb content may be 0.005 to 0.050%, in more detail, 0.01 to 0.040%.

Ti: 0.005 to 0.03%

In the case of addition of Ti, Ti is precipitated as TiN at the time of reheating to suppress growth of crystal grains in a base material and a weld heat affected zone, thereby significantly improving low-temperature toughness. To obtain effective precipitation of TiN, 0.005% or more of Ti should be added. However, an excessive addition exceeding 0.03% has a problem of clogging of a nozzle for continuous casting and or centering crystallization, thereby lowering low temperature toughness. Therefore, the Ti content may be 0.005 to 0.03%, and in more detail, 0.01 to 0.025%.

Cu: 0.2 to 0.6%

Cu is a main element for improving hardenability and enhancing strength of steel by causing solid solution strengthening, and is a main element for increasing yield strength through formation of Epsilon Cu precipitate under the application of tempering. Thus, 0.2% or more of Cu may be added. However, if the content of Cu is in excess of 0.6%, slab cracking due to hot shortness may occur in a steelmaking process. Therefore, the Cu content may be 0.2 to 0.6%, in more detail, 0.25 to 0.55%.

P: not more than 100 ppm, S: not more than 40 ppm

P and S are elements which induce brittleness in grain boundaries or cause coarse inclusions to induce brittleness. To improve brittle crack propagation resistance, the content of P may be limited to not more than 100 ppm and the content of S may be limited to not more than 40 ppm.

The remainder of the composition described above is Fe. However, in an ordinary manufacturing process, impurities which are not intended may be inevitably incorporated from a raw material or a surrounding environment, which cannot be excluded. These impurities are known to those skilled in the manufacturing field, and thus, are not specifically mentioned in this specification.

Hereinafter, the microstructure of the high-strength ultra-thick steel material according to an embodiment in the present disclosure will be described in detail.

The high-strength ultra-thick steel material according to an embodiment in the present disclosure contains 90 area % or more (including 100 area %) of bainite as a microstructure in a subsurface area up to t/10 (t hereafter being referred to as a thickness (mm) of a steel material), and a particle size of crystalline grains having a high inclination angle boundary of 15° or higher measured by EBSD is 10 μm or less (excluding 0 μm).

As described above, in general, since a sufficient deformation is not formed in the entire structure during manufacturing of a high strength ultra-thick steel material, the structure becomes coarse, and a cooling rate difference between the surface portion and the center portion occurs due to a thick thickness during rapid cooling for securing strength. As a result, a large amount of coarse low temperature transformation phase such as bainite or the like is generated on the surface portion, which makes it difficult to secure toughness.

However, according to an embodiment in the present disclosure, a preliminary bainite transformation takes place on a surface portion through cooling after rough rolling in a manufacturing process, and then, a surface bainite structure becomes fine through finishing rolling to resultantly obtain an ultra-thick steel material. As a result, it is controlled that a particle size of crystalline grains having a high inclination angle boundary of 15° or higher measured by EBSD, in a subsurface area of the ultra-thick steel material up to t/10 (t hereafter being referred to as a thickness of a steel material) is 10 μm or less (excluding 0 μm). Thus, an ultra-thick steel material, having excellent surface portion NRL-DWT physical properties, even in the case of containing bainite in a large amount (90 area % or more) on a surface portion, maybe provided. On the other hand, in the present disclosure, the residual structure outside the bainite in the subsurface up to a t/10 position is not particularly limited, but may be one or more selected from the group consisting of polygonal ferrite, acicular ferrite and martensite.

According to an example, the ultra-thick steel material according to an embodiment in the present disclosure may include 95 area % or higher (including 100 area %) of a composite structure of acicular ferrite and bainite and 5 area % or lower (including 0 area %) of martensite-austenite constituent, as a microstructure, in a subsurface area from a t/10 position to a t/2 position below a surface of the ultra-thick steel material. If the area ratio of the composite structure is less than 95% or the area ratio of the martensite-austenite constituent is more than 5 area %, impact toughness and CTOD physical properties of a base material may deteriorate.

According to an example of the present disclosure, in the case in which the composite structure, for example, acicular ferrite and bainite are included in combination, regardless of the fraction, the physical properties required in the present disclosure may be satisfied, and thus, the fraction of each phase of the composite structure is not particularly limited.

In the case of the high-strength ultra-thick steel material according to an embodiment in the present, the surface NRL-DWT physical properties are significantly excellent. According to an example, a Nil-Ductility Transition (NDT) temperature of a test specimen obtained from the surface of the high-strength ultra-thick steel material according to an embodiment is a −60° C. or less, the NDT temperature being based on Naval Research Laboratory-Drop Weight Test (NRL-DWT) regulated in ASTM 208-06.

In addition, the high-strength ultra-thick steel material according to an embodiment in the present disclosure has positive properties such as excellent low temperature toughness. According to an example, an impact transition temperature may be −40° C. or less at a test piece sampled on a t/4 position directly under the surface of the high-strength ultra-thick steel material.

Further, the high-strength ultra-thick steel material according to an embodiment in the present disclosure has positive properties in which yield strength is significantly excellent. According to an example, the high-strength ultra-thick steel material according to an embodiment has a plate thickness of 50 to 100 mm and a yield strength of 460 MPa or more.

The above-described high-strength ultra-thick steel material according to an embodiment in the present disclosure may be produced by various methods, and the production method thereof is not particularly limited. However, as a preferable example, the following method may be used as an example.

Hereinafter, a method of manufacturing an ultra-thick steel material excellent in physical properties of the surface portion NRL-DWT, in another embodiment of the present disclosure, will be described in detail. In the following description of the manufacturing method, unless otherwise stated, the temperature of a hot-rolled steel sheet (slab) refers to a temperature on a t/4 position (t: thickness of the steel sheet) from the surface of the hot-rolled steel sheet (slab) in a thickness direction, which is applied to a position that is the standard of measurement of a cooling rate at the time of cooling, in the same manner.

First, a slab having the above-mentioned component system is reheated.

According to an example, a slab reheating temperature may be 1000 to 1150° C., and in detail, 1050 to 1150° C. If the reheating temperature is less than 1000° C., the Ti and/or Nb carbonitride formed during casting may not be sufficiently solidified. On the other hand, if the reheating temperature exceeds 1150° C., austenite may be coarsened.

Next, the reheated slab is rough-rolled.

According to an example, a rough rolling temperature may be 900 to 1150° C. When the rough rolling is carried out in the above-mentioned temperature range, there are positive properties in which the grain size may be reduced through recrystallization of coarse austenite together with the destruction of a cast structure such as dendrite or the like formed during casting.

According to an example, a cumulative rolling reduction during rough rolling may be 40% or more. When the cumulative rolling reduction is controlled within the above-described range, sufficient recrystallization may be caused to obtain a fine structure.

Next, the rough-rolled slab is cooled. This process is an operation in which bainite transformation occurs in the surface portion before finish rolling. The cooling in this case may refer to water cooling.

At this time, the cooling termination temperature may be Ar3° C. or higher (Ar3+100° C.) or lower. If the cooling termination temperature exceeds (Ar3+100)° C., bainite transformation does not sufficiently take place on the surface portion during cooling, and thus, reverse transformation by rolling and heat recuperation does not occur during finish rolling a post process, thereby causing a problem in which a final structure on the surface portion is coarsened. On the other hand, if the cooling termination temperature is lower than Ar3° C., transformation takes place not only on the surface portion but also in a subsurface t/4 position below the surface of the steel material, and ferrite produced during slow cooling may be stretched while being subjected to two-phase region rolling, thereby deteriorating strength and toughness.

At this time, the cooling rate may be 0.5° C./sec or more. If the cooling rate is less than 0.5° C./sec, bainite transformation does not occur sufficiently on the surface portion, and the reverse transformation due to rolling and heat recuperation does not occur during the post-process finish rolling, thereby causing a problem in which a final structure on the surface portion is coarsened. On the other hand, the higher the cooling rate is, the more advantageous is the securing of the required structure. Thus, an upper limit thereof is not particularly limited, but it is actually difficult to obtain a cooling rate exceeding 10° C./sec even in the case of cooling performed with cooling water. When considered this, the upper limit may be limited to 10° C./sec.

Next, the cooled slab is subjected to finish rolling to obtain a hot-rolled steel sheet. In this case, a finish rolling temperature is determined in relation to the cooling termination temperature of the rough-rolled slab. Thus, in the present disclosure, the finish rolling temperature is not particularly limited. However, if the finishing temperature of finish rolling is less than Ar3° C. (a t/4 position from the surface of the slab in a plate thickness direction), it may be difficult to obtain the required structure. Thus, the finishing temperature of finish rolling may be limited to Ar3° C. or more.

Next, the hot-rolled steel sheet is water-cooled.

According to an example, the cooling rate during water cooling may be 3° C./sec or more. If the cooling rate is less than 3° C./sec, the microstructure in central portion of the hot-rolled steel sheet is not properly formed, and the yield strength may be lowered.

According to an example, the cooling termination temperature during water cooling may be 600° C. or lower. If the cooling termination temperature exceeds 600° C., the microstructure in central portion of the hot-rolled steel sheet may not be properly formed and the yield strength maybe lowered.

Hereinafter, embodiments of the present disclosure will be described in more detail with reference to examples. However, the description of these embodiments is only intended to illustrate the practice of the present disclosure, but the present disclosure is not limited thereto. The scope of the present disclosure is determined by the matters described in the claims and the matters reasonably deduced therefrom.

MODE FOR INVENTION

Embodiment

A steel slab having a thickness of 400 mm having the composition shown in Table 1 was reheated at 1060° C. and then subjected to rough rolling at a temperature of 1020° C., to produce a bar. The cumulative rolling reduction rate in rough rolling was 50% and the rough rolling bar thickness was 200 mm. After the rough rolling, the bar was cooled under the conditions shown in Table 2, followed by finish rolling to obtain a hot-rolled steel sheet. Thereafter, the steel sheet was water cooled to a temperature of 300 to 400° C. at a cooling rate of 3.5 to 5° C./sec, thereby manufacturing an ultra-thick steel material.

Then, the microstructure of the prepared ultra-thick steel material was analyzed and the tensile properties were evaluated. The results are shown in Table 3 below. In this case, the steel microstructure was observed with an optical microscope, and the tensile properties were measured by a normal room temperature tensile test.

TABLE 1

| | Steel Composition (weight %) | | | | | | | | | |
|---|---|---|---|---|---|---|---|---|---|---|
| Steel Grade | C | Mn | Si | Al | Ni | Cu | Ti | Nb | P (ppm) | S (ppm) |
| Inventive Steel 1 | 0.085 | 1.63 | 0.23 | 0.03 | 1.02 | 0.53 | 0.017 | 0.032 | 68 | 10 |
| Inventive Steel 2 | 0.065 | 1.85 | 0.21 | 0.04 | 0.58 | 0.29 | 0.022 | 0.022 | 72 | 11 |
| Inventive Steel 3 | 0.048 | 2.05 | 0.15 | 0.02 | 0.72 | 0.35 | 0.012 | 0.025 | 83 | 9 |
| Inventive Steel 4 | 0.077 | 1.87 | 0.35 | 0.03 | 0.63 | 0.41 | 0.017 | 0.038 | 68 | 8 |
| Inventive Steel 5 | 0.068 | 1.98 | 0.27 | 0.04 | 0.79 | 0.32 | 0.016 | 0.022 | 72 | 13 |
| Comparative Steel 1 | 0.14 | 2.01 | 0.28 | 0.02 | 0.63 | 0.31 | 0.026 | 0.036 | 81 | 12 |
| Comparative Steel 2 | 0.065 | 2.56 | 0.31 | 0.03 | 0.59 | 0.31 | 0.016 | 0.037 | 59 | 12 |
| Comparative Steel 3 | 0.025 | 1.21 | 0.29 | 0.01 | 0.72 | 0.26 | 0.015 | 0.013 | 72 | 18 |
| Comparative Steel 4 | 0.079 | 1.92 | 0.16 | 0.02 | 0.12 | 0.38 | 0.023 | 0.026 | 63 | 13 |
| Comparative Steel 5 | 0.067 | 1.72 | 0.45 | 0.03 | 0.67 | 0.29 | 0.065 | 0.078 | 59 | 9 |

TABLE 2

| Steel Grade | Thickness of Hot Rolled Steel Sheet (mm) | Cooling Termination Temperature based on ¼ t (° C.) | Cooling Rate (° C./sec) | t/4 position temperature during final pass rolling (° C.) | Remarks |
|---|---|---|---|---|---|
| Inventive Steel 1 | 95 | Ar3 + 15 | 4.1 | Ar3 + 3 | Embodiment Example 1 |
| | 95 | Ar3 − 53 | 4.3 | Ar3 − 64 | Comparative Example 1 |
| Inventive Steel 2 | 80 | Ar3 + 45 | 5.6 | Ar3 + 19 | Embodiment Example 2 |
| | 80 | Ar3 + 138 | 5.2 | Ar3 + 115 | Comparative Example 2 |
| Inventive Steel 3 | 95 | Ar3 + 71 | 4.0 | Ar3 + 46 | Embodiment Example 3 |
| | 95 | Ar3 + 152 | 4.2 | Ar3 + 105 | Comparative Example 3 |
| Inventive Steel 4 | 100 | Ar3 + 36 | 3.8 | Ar3 + 15 | Embodiment Example 4 |
| | 100 | Ar 3 − 38 | 3.7 | Ar3 − 51 | Comparative Example 4 |
| Inventive Steel 5 | 80 | Ar3 + 45 | 5.4 | Ar3 + 16 | Embodiment Example 5 |

TABLE 2-continued

| Steel Grade | Thickness of Hot Rolled Steel Sheet (mm) | Cooling Termination Temperature based on ¼ t (° C.) | Cooling Rate ( ° C./sec) | t/4 position temperature during final pass rolling (° C.) | Remarks |
|---|---|---|---|---|---|
| Comparative Steel 1 | 80 | Ar3 + 14 | 5.7 | Ar3 + 2 | Comparative Example 5 |
| Comparative Steel 2 | 85 | Ar3 + 32 | 5.6 | Ar3 + 13 | Comparative Example 6 |
| Comparative Steel 3 | 90 | Ar3 + 27 | 4.5 | Ar3 + 11 | Comparative Example 7 |
| Comparative Steel 4 | 90 | Ar3 + 19 | 4.7 | Ar3 + 6 | Comparative Example 8 |
| Comparative Steel 5 | 95 | Ar3 + 44 | 4.0 | Ar3 + 35 | Comparative Example 9 |

(In Table 2, final pass rolling refers to finish rolling)

TABLE 3

| | Surface Microstructure (Subsurface Area up to t/10) | | Center Microstructure (Subsurface Area from t/10 Position to t/2 Position) | Tensile Properties | | | |
|---|---|---|---|---|---|---|---|
| Steel Grade | B Phase Fraction (Area %) | Crystal line Grain Size (μm) | AF + B Phase Fraction (Area %) | Yield Strength (MPa) | NDT Temperature (° C.) | Impact Transition Temperature (° C.) | Remarks |
| Inventive Steel 1 | 100 | 8.2 | 98 | 528 | −70 | −59 | Embodiment Example 1 |
| | 100 | 6.8 | 68 | 438 | −70 | −70 | Comparative Example 1 |
| Inventive Steel 2 | 100 | 7.8 | 98 | 485 | −70 | −62 | Embodiment Example 2 |
| | 98 | 28.6 | 99 | 544 | −40 | −40 | Comparative Example 2 |
| Inventive Steel 3 | 92 | 8.6 | 98 | 502 | −65 | −72 | Embodiment Example 3 |
| | 97 | 32.3 | 97 | 559 | −35 | −35 | Comparative Example 3 |
| Inventive Steel 4 | 92 | 9.3 | 98 | 496 | −75 | −68 | Embodiment Example 4 |
| | 100 | 7.2 | 72 | 446 | −65 | −65 | Comparative Example 4 |
| Inventive Steel 5 | 100 | 7.1 | 99 | 487 | −70 | −75 | Embodiment Example 5 |
| Comparative Steel 1 | 97 | 8.9 | 97 | 589 | −55 | −38 | Comparative Example 5 |
| Comparative Steel 2 | 93 | 9.2 | 98 | 603 | −50 | −55 | Comparative Example 6 |
| Comparative Steel 3 | 72 | 15.2 | 48 | 326 | −65 | −64 | Comparative Example 7 |
| Comparative Steel 4 | 98 | 7.9 | 97 | 535 | −40 | −36 | Comparative Example 8 |
| Comparative Steel 5 | 100 | 7.8 | 98 | 572 | −55 | −35 | Comparative Example 9 |

* In the microstructure, AF refers to acicular ferrite and B refers to bainite.

* In all steel grades, the remainder of the structure except for B in a subsurface area up to t/10 (t means a thickness (mm)) is one of polygonal ferrite, acicular ferrite or martensite, and the remainder of the structure except for AF and B is martensite-austenite constituent in an area from a t/10 position to a t/2 position.

As can be seen from Table 3, in the case of Embodiment Examples 1 to 5, satisfying all the conditions proposed in the present disclosure, it can be seen that with a test piece having a yield strength of 460 MPa or more and taken at a t/4 position directly under the surface, the Nil-Ductility Transition (NDT) temperature according to the Naval Research Laboratory-Drop Weight Test (NRL-DWT) specified in ASTM 208-06 is not more than −60 degrees.

Meanwhile, in the case of Comparative Examples 1 and 4, it can be seen that, since the cooling termination temperature during cooling after the rough rolling is less than Ar3° C., sufficient bainite transformation occurs on the surface portion during cooling, so that the grain size is reduced due to reverse transformation during finish rolling. However, it can be seen that the yield strength is lowered to less than 460 MPa as a large amount of soft phase is generated in the center portion.

Further, in the case of Comparative Examples 2 and 3, it can be seen that since the cooling termination temperature in cooling after rough rolling exceeds (Ar3+100° C.) and thus sufficient bainite transformation does not occur on the surface portion during cooling, reduction in the grain size due to reverse transformation during finish rolling is not obtained, such that after the water-cooling, coarse bainite is generated on the surface portion, and thus, the impact transition temperature and the Nil-Ductility Transition (NDT) temperature is out of the range proposed in the present disclosure.

In the case of Comparative Example 5, fine bainite was generated on the surface portion by having a value higher than the C upper limit proposed in the present disclosure, but the impact transition temperature and the Nil-Ductility Transition (NDT) temperature was outside of the scope proposed in the present disclosure due to a relatively high content of C.

In the case of Comparative Example 6, fine bainite was generated on the surface portion by having a value higher than the Mn upper limit proposed in the present disclosure, but high-strength bainite was produced due to a high Mn content. As a result, it can be seen that the Nil-Ductility Transition (NDT) temperature is outside of the range suggested by an embodiment in the present disclosure.

In Comparative Example 7, a soft phase was generated in a large amount on the surface portion and the center portion by having a lower value than the lower limits of C and Mn suggested in the present disclosure, and thus the particle size on the surface portion was coarsened. In detail, it can be seen that as a large amount of soft phase in the center portion is generated, the yield strength is lower than the yield strength of 460 MPa proposed in the present disclosure.

In the case of the comparative example 8, a sufficiently fine bainite structure was generated on the surface portion by having a lower value than the Ni upper limit supposed in the present disclosure, but the impact transition temperature and the Nil-Ductility Transition (NDT) temperature were outside of the range suggested in the present disclosure due to a decrease in toughness based on a relatively low content of Ni.

In the case of Comparative Example 9, the strength was increased due to excessive hardenability by having a higher value than the upper limits of Ti and Nb suggested in the present disclosure, and the impact transition temperature and the Nil-Ductility Transition (NDT) temperature were outside of the range suggested in the present disclosure by a decrease in toughness due to precipitation strengthening.

While embodiments have been shown and described above, it will be apparent to those skilled in the art that modifications and variations could be made without departing from the scope of the present disclosure as defined by the appended claims.

The invention claimed is:

1. A steel material comprising:

by weight %, 0.04 to 0.1% of carbon (C), 0.05 to 0.5% of silicon (Si), 0.01 to 0.05% of aluminum (Al), 1.6 to 2.2% of manganese (Mn), 0.5 to 1.2% of nickel (Ni), 0.005 to 0.050% of niobium (Nb), 0.005 to 0.03% of titanium (Ti), 0.2 to 0.6% of copper (Cu), 100 ppm or less of phosphorus (P), and 40 ppm or less of sulfur (S) with a remainder of iron (Fe), and inevitable impurities, and wherein the steel material has a microstructure in a subsurface area up to t/10, where t is a thickness in mm, comprising bainite of 90 area % or greater, wherein a particle size of crystalline grains of the steel material, having a high angle boundary of 15° or higher measured by EB SD, is 10 μm or less, excluding 0 μm, and wherein the steel material has a microstructure in a subsurface area from a t/10 to a t/2 comprising 95 area % or higher of a composite structure of acicular ferrite and bainite, and 5 area % or lower, of a martensite-austenite constituent, wherein a nil-ductility transition (NDT) temperature of a specimen taken from a surface of the steel material, according to a naval research laboratory-drop weight test (NRL-DWT) regulated in ASTM 208-06, is −60° C. or lower.

2. The steel material of claim 1, wherein a specimen taken from a subsurface t/4 position below a surface of the steel material has an impact transition temperature of −40° C. or lower.

3. The steel material of claim 1, wherein a plate thickness of the steel material is 50 to 100 mm, and the steel material has yield strength of 460 MPa or more.

4. A method of manufacturing the steel material of claim 1, the method comprising:

reheating a slab including, by weight %, 0.04 to 0.1% of carbon (C), 0.05 to 0.5% of silicon (Si), 0.01 to 0.05% of aluminum (Al), 1.6 to 2.2% of manganese (Mn), 0.5 to 1.2% of nickel (Ni), 0.005 to 0.050% of niobium (Nb), 0.005 to 0.03% of titanium (Ti), 0.2 to 0.6% of copper (Cu), 100 ppm or less of phosphorus (P), and 40 ppm or less of sulfur (S) with a remainder of iron (Fe), and inevitable impurities;

rough-rolling the slab reheated in the reheating slab, and then, cooling the slab to a temperature of Ar3° C. or higher to (Ar3+100)° C. or lower, at a rate of 0.5° C/sec or more; and finish-rolling the slab cooled in the cooling, and then, water-cooling the slab.

5. The method of claim 4, wherein a temperature at which the slab is reheated is 1000 to 1150° C.

6. The method of claim 4, wherein the rough rolling is performed at a temperature of 900 to 1150° C.

7. The method of claim 4, wherein a cumulative reduction ratio during the rough-rolling is 40% or more.

8. The method of claim 4, wherein a cooling rate in the water-cooling is 3° C/sec or more.

9. The method of claim 4, wherein a cooling termination temperature in the water- cooling is 500° C. or lower.

* * * * *